US006912979B2

(12) United States Patent
Fleig et al.

(10) Patent No.: US 6,912,979 B2
(45) Date of Patent: Jul. 5, 2005

(54) METHOD FOR OPERATING A TWO-STROKE ENGINE HAVING MIXTURE INDUCTION

(75) Inventors: Claus Fleig, Ludwigsburg (DE); Werner Geyer, Berglen (DE); Jörg Schlossarczyk, Winnenden (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 10/656,167

(22) Filed: Sep. 8, 2003

(65) Prior Publication Data

US 2004/0045517 A1 Mar. 11, 2004

(30) Foreign Application Priority Data

Sep. 6, 2002 (DE) ..... 102 41 213

(51) Int. Cl.[7] ..... F02B 33/04
(52) U.S. Cl. ..... 123/73 PP; 123/73 A
(58) Field of Search ..... 123/65 P, 73 PP, 123/73 A, 73 R; 261/35

(56) References Cited

U.S. PATENT DOCUMENTS 6,234,456 B1 * 5/2001 Gerhardy ..... 261/35
6,298,811 B1 * 10/2001 Sawada et al. ..... 123/73 A
6,571,756 B1 6/2003 Rosskamp et al.
6,595,169 B2 * 7/2003 Raffenberg et al. ..... 123/73 A
2002/0100438 A1 8/2002 Raffenberg et al.

FOREIGN PATENT DOCUMENTS

EP 0 302 045 2/1989

* cited by examiner

*Primary Examiner*—Henry C. Yuen
*Assistant Examiner*—Hyder Ali
(74) *Attorney, Agent, or Firm*—Walter Ottesen

(57) ABSTRACT

The invention relates to a method for operating a two-stroke engine having scavenging-advance storage. The combustion chamber (3) which in configured in the cylinder (2) is supplied with an air/fuel mixture via a transfer channel (12, 15). This air/fuel mixture is drawn by induction through an inlet into the crankcase (4) during the intake phase. During the intake phase, a fuel-free fluid such as pure air is inducted via a fluid channel (17) and stored in the transfer channel. To obtain good exhaust-gas values while also having reduced fuel consumption and reliable lubrication, lambda (λ) of the air/fuel mixture, which is stored in the crankcase (4), is adjusted in a range of approximately 0.2 to 0.6 in the part-load and full-load ranges of the two-stroke engine (1).

12 Claims, 5 Drawing Sheets

Fig. 4
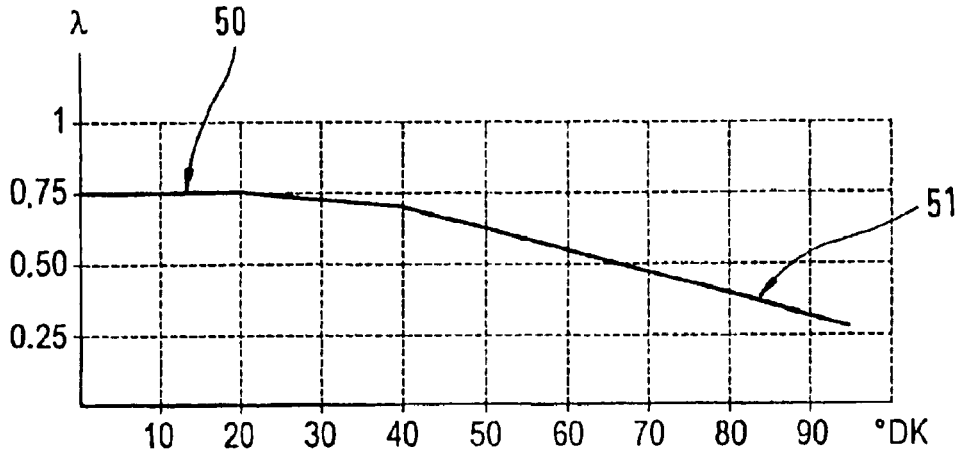
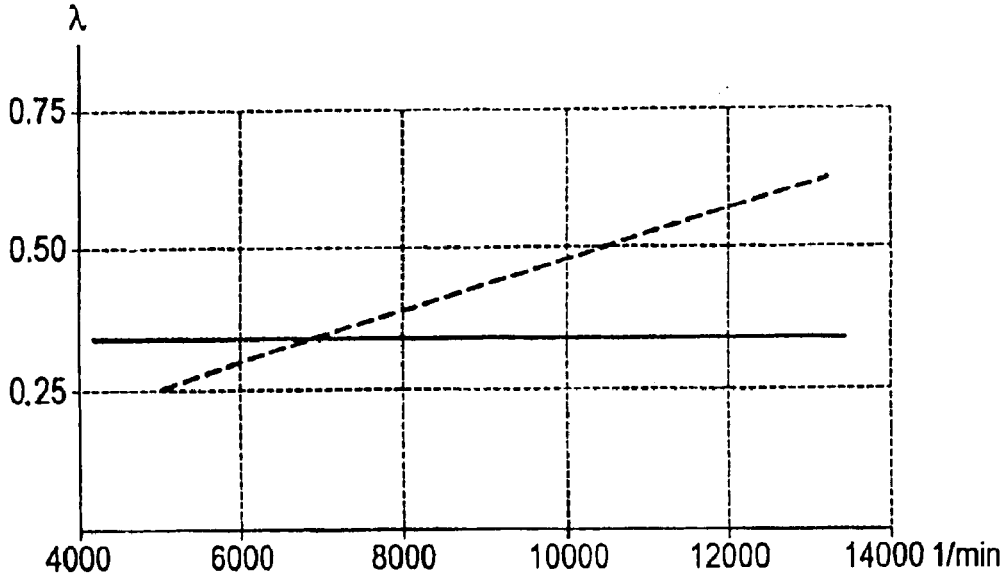
Fig. 5

METHOD FOR OPERATING A TWO-STROKE ENGINE HAVING MIXTURE INDUCTION

BACKGROUND OF THE INVENTION

U.S. Pat. No. 6,571,756 discloses a membrane-controlled two-stroke engine which draws an air/fuel mixture into the crankcase via an inlet and inducts fuel-free fluid such as pure air into the transfer channel via a membrane-controlled fluid channel. Pure air passes from the transfer channel window into the crankcase at the crankcase end of the transfer channel whereby the mixture, which is stored in the crankcase, is made lean. A corresponding quantity of oil must be supplied to the crankcase with the fuel in order to ensure an adequate lubrication of the moving parts in the crankcase. This leads to a coking in the muffler as well as in the combustion chamber and causes poor exhaust-gas values.

European patent publication 0,302,045 discloses an internal combustion engine having crankcase scavenging wherein the necessary combustion air is drawn by suction via the crankcase and the fuel, which is needed for operation, is injected into the combustion chamber via an injection nozzle in the region of the inlet window. An operation of a two-stroke engine of this kind requires, however, a separate lubrication system in the crankcase which is complex and can lead to an increased entry of oil into the combustion chamber.

SUMMARY OF THE INVENTION

It is an object of the invention to provide a method for operating a two-stroke engine having scavenging advance storage wherein good exhaust-gas values are obtained with excellent lubrication of all moving parts.

The method of the invention is for operating a two-stroke engine including a two-stroke engine for a portable handheld work apparatus. The two-stroke engine includes: a crankcase; a cylinder connected to the crankcase; the cylinder having a cylinder wall defining a cylinder; a piston displaceably mounted in the cylinder for reciprocating movement therein and the piston and the cylinder conjointly defining a combustion chamber; a crankshaft rotatably mounted in the crankcase; a connecting rod connecting the piston to the crankshaft so as to permit the piston to drive the crankshaft as the piston reciprocates in the cylinder; the crankcase having an inlet through which an air/fuel mixture is drawn into the crankcase during an intake phase of the engine; a transfer channel for conducting the air/fuel mixture from the crankcase into the combustion chamber; and, a fluid channel communicating with the transfer channel. The method of the invention includes the steps of: drawing a fluid into the transfer channel through the fluid channel during the intake phase and storing the inducted fluid in the transfer channel with the fluid being a fuel-poor to fuel-free fluid; and, adjusting lambda ($\lambda$) of the air/fuel mixture stored in the crankcase in a range of approximately 0.2 to 0.6.

The mixture stored in the crankcase is adjusted to very rich in the part-load and full-load ranges of the two-stroke engine and the value of lambda lies in a range of approximately 0.2 to 0.6. The rich mixture deposits on the moving parts in the crankcase and vaporizes whereby heat is drawn away from the crankcase because of the vaporization process. An excellent cooling of the engine results. The problem of icing of the carburetor is reduced because of the vaporization of the fuel in the crankcase.

Furthermore, the depositing fuel/oil wall film in the crankcase leads to an improved thermal transfer because the thermal transport from a crankcase, which is, for example, made of aluminum, to a wall film is better than to a gaseous mixture.

The developing fuel/oil wall film also provides a significantly better lubrication so that a defective lubrication of the moving parts is avoided.

The improved preparation of the fuel in the crankcase in combination with the improved lubrication makes possible a lower metering of the total fuel and oil quantities so that a reduced coking is present in the muffler and in the combustion chamber.

Preferably, lambda is adjusted in the range of 0.3 to 0.5. At idle, lambda is greater than 0.6 and drops to a value of approximately 0.3 with increasing load. Lambda preferably drops approximately continuously as a function of load.

In a special embodiment of the invention, the inducted fluid volume (fuel poor to fuel free, for example, a pure air volume) is stored completely in the transfer channel or in the transfer channels in the case of a multi-channel engine. The volume of a transfer channel or the sum of the total volume of several such transfer channels lies between an inlet window in the combustion chamber and a transfer window to the crankcase. This volume is designed to be greater than the fluid volume (fuel poor to fuel free) under full load. In this way, an overflowing of the transfer channels into the crankcase is avoided so that the adjustment of a low lambda is easily possible via the carburetor. Preferably, the total volume of the transfer channels is approximately 15% to 35% of the piston displacement of the engine.

BRIEF DESCRIPTION OF THE DRAWINGS

The invention will now be described with reference to the drawings wherein:

FIG. 4 shows the course of lambda in the crankcase plotted as a function of the throttle flap angle;

FIG. 5 is a trace of lambda in the crankcase plotted as a function of the engine rpm (1/min);

DESCRIPTION OF THE PREFERRED EMBODIMENTS OF THE INVENTION

Figure 1:
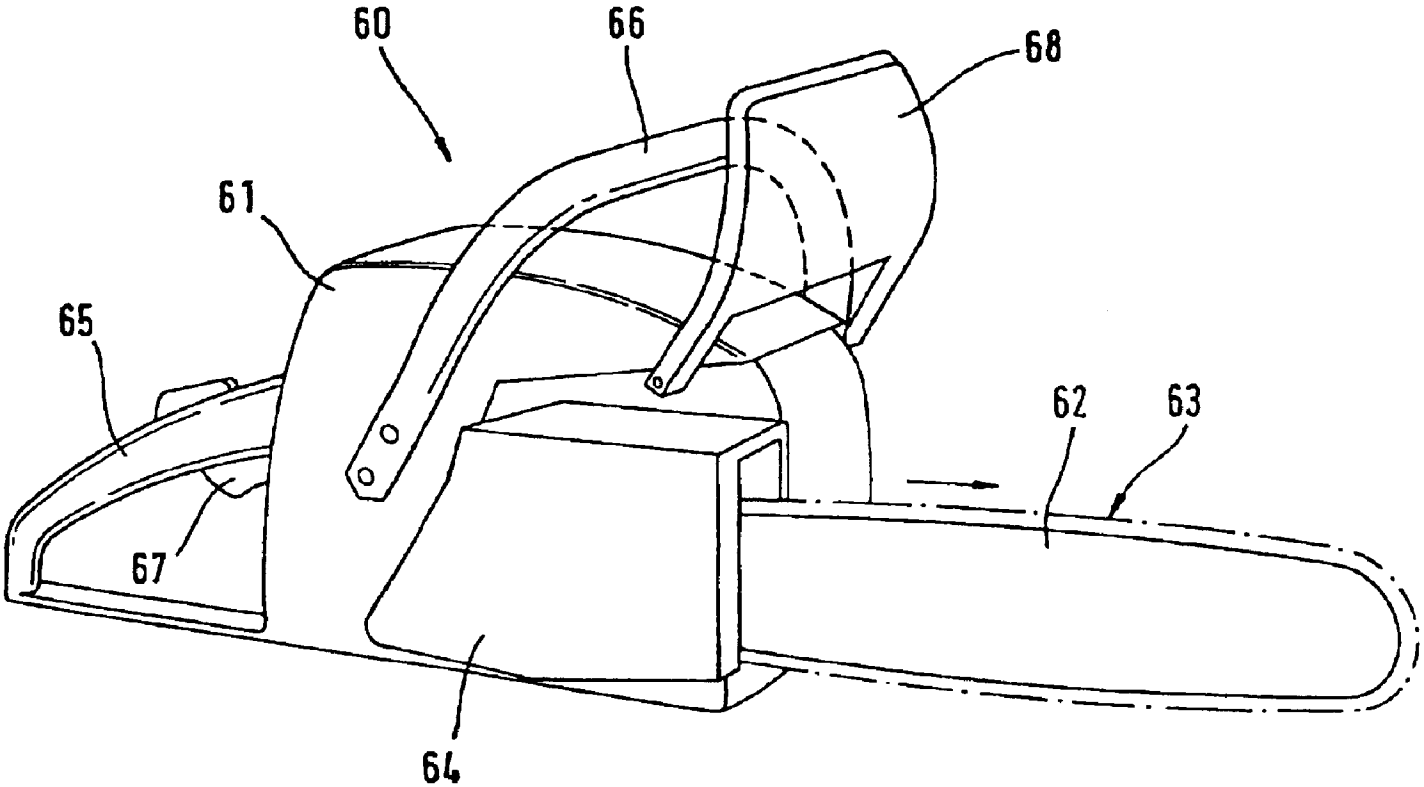
FIG. 1 is a schematic of a portable handheld work apparatus such as a motor-driven chain saw.
Figure 2:
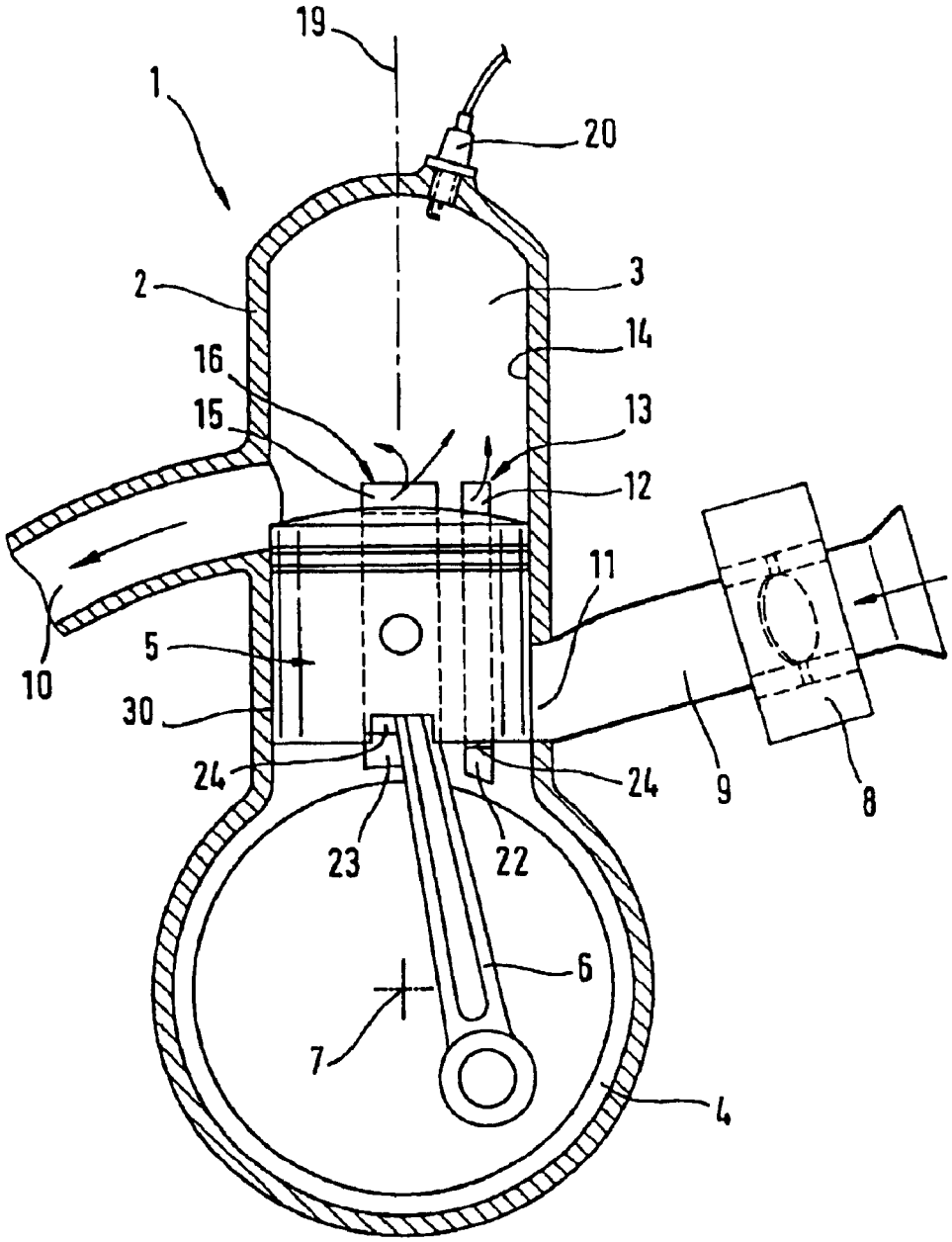
FIG. 2 is a side elevation view, partially in section, taken through an internal combustion engine arranged in the motor-driven chain saw of FIG. 1.
Figure 6:
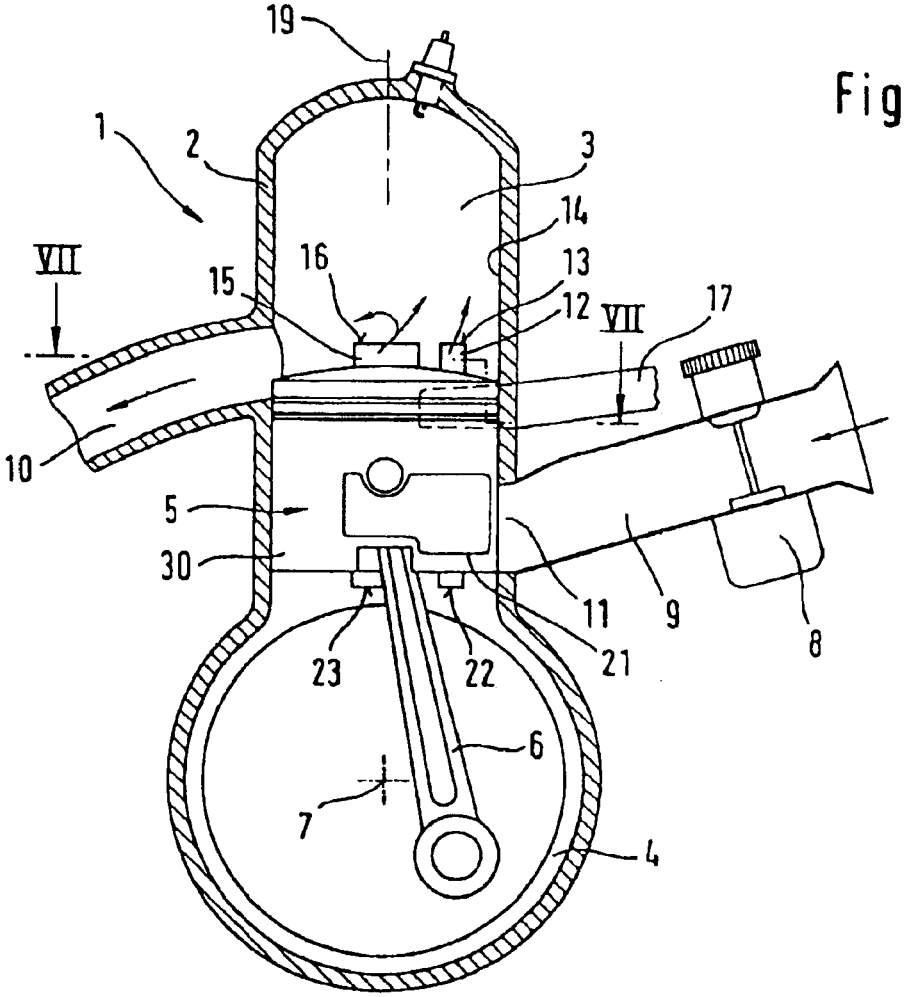
FIG. 6 is a section view taken through a piston-port controlled internal combustion engine; and, FIG. 7 is a section view taken along line VII—VII in FIG. 6.

The portable handheld work apparatus shown in FIG. 1 is a motor-driven chain saw 60 having an internal combustion engine mounted in its housing 61 as shown schematically in FIGS. 2 and 6. The engine drives a work tool which, in the motor-driven chain saw shown, is a saw chain 63 running about a guide bar 62. The guide bar is fixedly clamped to the housing 61 of the engine by means of a sprocket wheel cover 64. For carrying and guiding the work apparatus, a rearward handle 65 as well as an upper handle 66 are provided. A throttle lever 67 for operating the engine is provided in the rearward handle 65. A hand protector 68 is mounted forward of the upper forward handle 66.

The engine 1 shown schematically in FIG. 2 is a two-stroke engine having scavenging advance storage. The engine comprises essentially a cylinder 2 and a crankcase 4 mounted at the foot of the cylinder 2. In the cylinder 2, a combustion chamber 3 is formed which is delimited by a reciprocating piston 5. The piston 5 drives a crankshaft 7 via a connecting rod 6. The crankshaft 7 is mounted in the crankcase 4.

For operating the engine 1, an air/fuel mixture is inducted into the crankcase 4 through an inlet 11 which, in this embodiment, is a piston-port control inlet. The air/fuel mixture is prepared in a carburetor 8 which is connected to the inlet 11 via an inlet channel 9.

Referred to the longitudinal center axis 19 of the cylinder 2, an outlet 10 lies opposite the inlet 11 offset in elevation. Combustion gases are discharged from the combustion chamber 3 via the outlet 10.

The mixture metering from the crankcase 4 to the combustion chamber 3 takes place via at least one transfer channel (12, 15) which can be configured in the cylinder wall 14. The transfer channels (12, 15) can also be outer channels.

In the embodiment shown, there are a total of four transfer channels (12, 15) of which each two are arranged on one side of a plane containing the longitudinal center axis 19 and running through the inlet 11 and the outlet 10. In FIG. 2, the two transfer channels 12 and 15 are shown on the one side of the cylinder 2. Each transfer channel (12, 15) opens into the combustion chamber 3 with an entry window (13, 16) and ends with transfer windows (22, 23) in the crankcase 4. The transfer channels (12, 15) are delimited to the cylinder interior space by a channel wall 24 which lies in the plane of the cylinder wall 14.

In the downward movement of the piston shown in FIG. 2, the air/fuel mixture, which is inducted into the crankcase 4, is compressed and flows via the transfer windows 22 and 23 through the transfer channels 12 and 15 and the entry windows 13 and 16 into the combustion chamber 3. In the following upward movement of the piston, the entry windows (13, 16) as well as the outlet 10 are closed while, simultaneously, the inlet 11 is opened by the skirt 30 of the piston. Because of the underpressure, which develops in the crankcase 4 with the upward movement of the piston 5, an air/fuel mixture, which is prepared in the carburetor 8, is inducted via the inlet channel 9.

According to the invention, it is provided that the air/fuel mixture, which is supplied to the crankcase 4, is adjusted in such a manner that, in the crankcase 4, a value of lambda results in a range of approximately 0.2 to 0.6 as a function of load. Preferably, lambda is adjusted in a range of 0.3 to 0.5. At idle, lambda is preferably greater than 0.6 and falls with increasing load to a value of approximately 0.3 at full load 51. This drop is especially approximately continuous. In a part-load range 50 which follows idle, lambda is held approximately constant.

Figure 3:
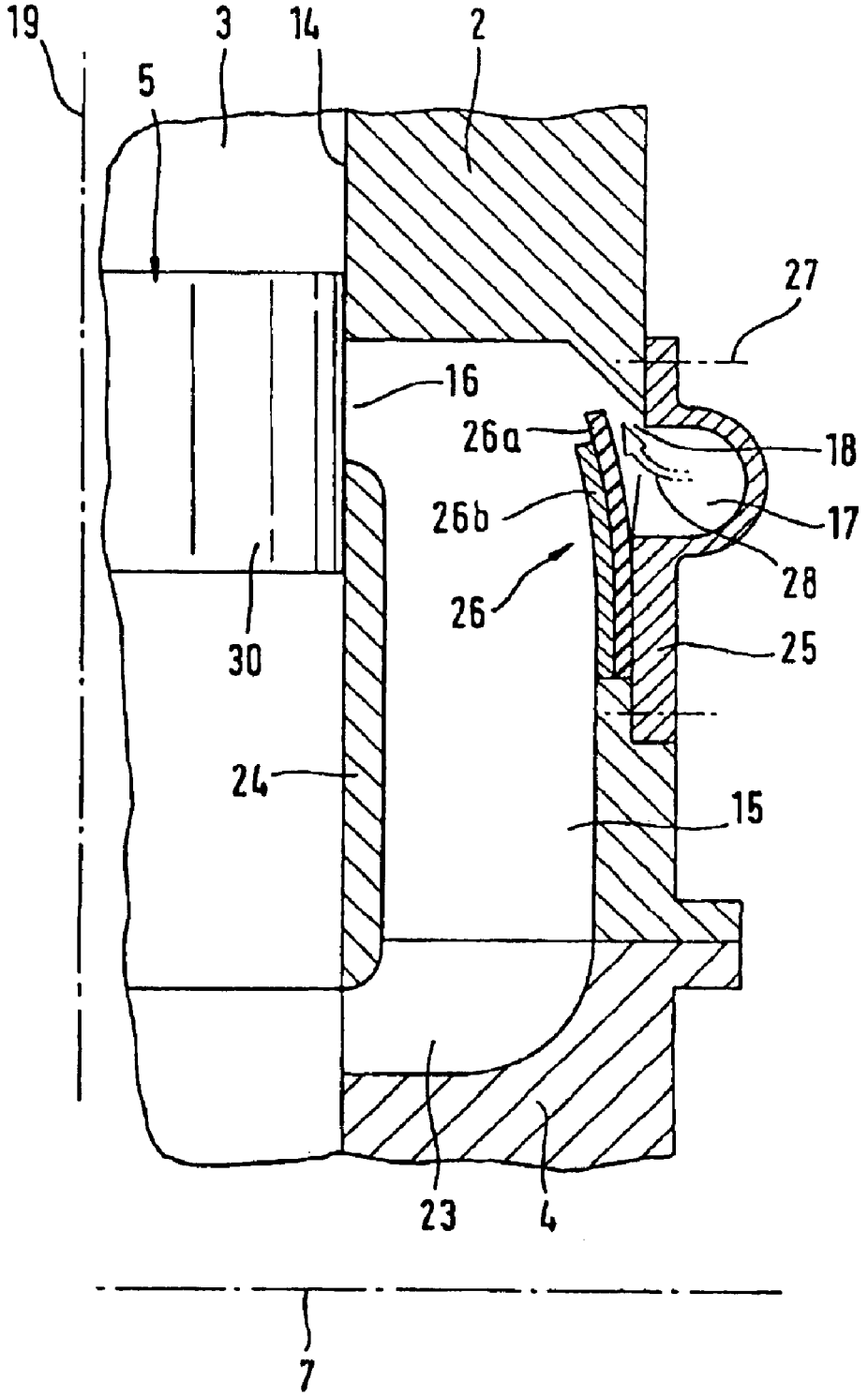
FIG. 3 is a section view taken through the transfer channel of the engine of FIG. 2.

In the combustion chamber 3, in contrast, and preferably after the outlet is closed and before the transfer channels are opened, lambda is adjusted at approximately 0.7 to 0.95 over the entire load range. For this purpose, a fuel-poor to fuel-free fluid, especially fresh air, is conducted into the transfer channels (12, 15) via a fluid channel 17. In FIG. 3, a section view is shown through the outlet-near transfer channel 15. The channel 15 is formed in the wall of the cylinder 2 and an inner wall 24 delimits the channel 15 with respect to the interior space of the cylinder. The inner wall 24 is part of the cylinder wall 14. The transfer channel 15 is closed radially to the outside by a cover 25 seated on the cylinder 2. The cover 25 is fixed on the cylinder 2 by means of attachment elements 27. A part of the fluid channel 17 is formed in the cover 25. The fluid channel communicates via a fluid window 18 with the transfer channel 15. In the shown open position, a membrane 26*a* is supported by a stiff membrane holder 26*b* and conjointly forms therewith a membrane valve 26 which controls the fluid window 18.

With an upward movement of the piston 5 in the longitudinal direction of the longitudinal center axis 19, an underpressure results in the crankcase 4 which is not only present at the inlet 11 but also at the transfer windows 22 and 23 of the transfer channels 12 and 15. Because of the underpressure, the membrane valve 26 opens the fluid window 18 and fuel-poor to fuel-free fluid (especially pure air) flows according to arrow 28 through the fluid window 18 into the transfer channel 15 and displaces an air/fuel mixture of a previous transfer cycle which may possibly still be disposed therein.

The transfer channel 15 is so configured that the inducted fluid air volume or pure air volume is stored essentially completely in the transfer channel 15. For this reason, the total volume of the transfer channel 15, which lies between the entry window 16 into the combustion chamber 3 and the transfer window 23 to the crankcase 4, is designed to be equal, preferably greater, than the fluid volume or pure air volume inducted by the engine 1 under full load. The configuration in the embodiment of FIG. 2 is so made that the inducted fluid volume is stored in the total volume made up of the two transfer channels 12 and 15. It can be practical to utilize only the outlet-near transfer channel 15 as a storage volume for the inducted fluid volume.

The inducted fuel-poor to fuel-free fluid volume is stored only in the transfer channel 15 and therefore little or no fluid enters into the crankcase 4 from the transfer window 23. For this reason, the rich air/fuel mixture, which is inducted via the inlet 11, remains essentially unchanged in its composition so that the adjustment of the lambda of 0.2 to 0.6 in the crankcase is easily possible via the carburetor 8.

If an overflow of fuel-poor or fuel-free fluid (especially pure air) is permitted into the crankcase 4 from the transfer channels (12, 15), then this would not be adjusted to more than 20% to 30% of the channel volume of the transfer channels (12, 15). With an adjustment of the overflow volume of this kind, the adjustment of lambda of approximately 0.2 to 0.6 can be ensured in the crankcase as a function of the load.

The course of lambda under load is shown in FIG. 4. Lambda is plotted along the y-axis and the throttle flap angle (°DK) of a throttle flap mounted in the carburetor 8 is plotted on the x-axis (see FIG. 2). In a first part-load range 50, which follows idle, the lambda remains relatively large and corresponds approximately to the lambda value of about 0.75 which adjusts in the combustion chamber. Beyond the part-load range 50, lambda (λ) in the crankcase 4 drops with increasing load or throttle flap angle continuously to a value of about 0.2 at full load for a fully opened throttle flap (90°) at the end of the full-load range 51.

If one plots lambda, which adjusts in the crankcase, as a function of rpm (1/min), then, at low rpms under load, a value lambda of about 0.3 results which increases at high rpm under load to approximately 0.6. This behavior is significant for a membrane-controlled fluid window 18.

Figure 7:
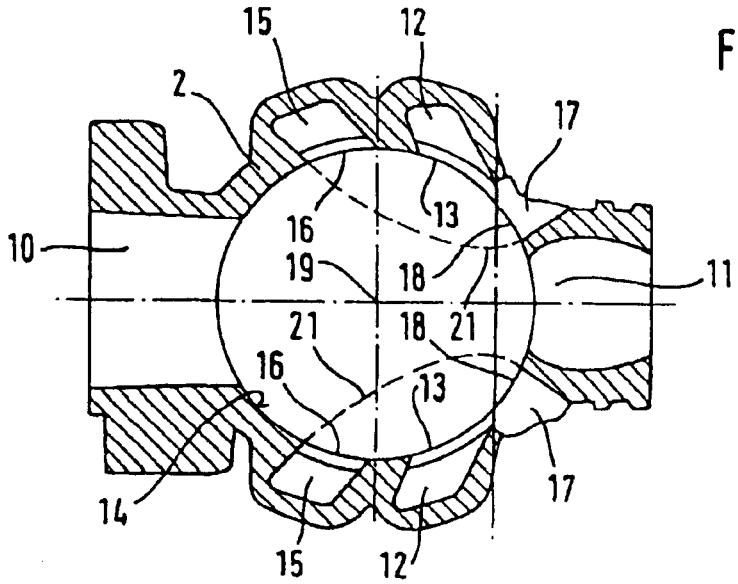

In contrast to the membrane-controlled scavenging engine shown in FIGS. 2 and 3, a piston-port controlled scavenging engine 1 is shown in FIGS. 6 and 7. The scavenging engine corresponds to the configuration of the membrane-controlled scavenging engine of FIGS. 2 and 3 except for the connection of the fluid channel 17 to the transfer channels 12 and 15. Accordingly, the same parts are identified by the same reference numerals.

As shown in FIGS. 6 and 7, the fluid channel 17 opens via a fluid window 18 (FIG. 7) within the cylinder interior wall 14, preferably below an entry window (13, 16) of the transfer channels (12, 15) into the combustion chamber 3. A piston pocket 21 is formed in the piston jacket 30 and this pocket connects the fluid window 18 to the two transfer channels (12, 15) in a corresponding piston position. In FIG. 7, this is shown for a piston position during the induction phase.

The operation of the two-stroke engine of FIGS. 6 and 7 with the piston-port controlled inlet or fluid window 18 corresponds to the operation of the membrane-controlled two-stroke engine of FIGS. 2 and 3. During the upward movement of the piston 5, the inlet 11 is cleared by the piston jacket 30 so that the underpressure, which builds up in the crankcase 4, effects an induction of an air/fuel mixture via the inlet channel 9. Since the transfer windows 22 and 23 are open to the crankcase 4, the underpressure is also present in the transfer channels 12 and 15. As soon as the piston pocket 21 covers the fluid window 18 as well as the entry windows 13 and 16, fuel-poor to fuel-free fluid (especially fresh air) flows via fluid channel 17 and the fluid window 18 into the piston pocket 21 and from there via the entry windows 13 and 16 to the transfer channels 12 and 15. The transfer channels 12 and 15 are advantageously completely flowed through in the opposite direction by the fluid flow so that components of the air/fuel mixture, which are still present in the transfer channel from a previous transfer cycle, are scavenged or flushed out into the crankcase 4. The volume of the transfer channels 12 and 15 is so dimensioned that no or only a slight overflow of the fluid into the crankcase 4 takes place. In this way, the crankcase 4 can be operated with a rich air/fuel mixture having a value of lambda of 0.2 to 0.6.

The trace of lambda as a function of load (degree of opening of the throttle flap angle—°DK) corresponds approximately to the trace shown in FIG. 4 for a membrane-controlled two-stroke engine.

The plot of lambda as a function of rpm remains approximately constant at 0.3 as shown by the solid curve in FIG. 4.

The adjustment of a rich air/fuel mixture having a value lambda of 0.2 to 0.6 leads to an improved cooling of the engine because the heat-draining vaporization process of the fuel no longer takes place only in the carburetor but also in the crankcase. The problem of an icing of the carburetor is reduced.

In total, less fuel and oil is supplied to the crankcase and a better cooling is nonetheless obtained because an air/oil wall film can form in the crankcase because of the low lambda. The wall film leads to an improved heat transfer from the material of the crankcase to the mixture and corresponds to an injection-oil cooling known per se. The forming fuel/oil wall film leads also to an improved lubrication of the moving parts because a thicker lubricant film is obtained. The reduced quantities of fuel and oil needed reduce a coking in the muffler and in the combustion chamber.

In the embodiments, the inlet 11 to the crankcase 4 is piston-port controlled. In lieu of a piston-port controlled inlet 11, a membrane-controlled crankcase inlet or even a rotating-disc controlled inlet can be practical. A valve can be used as a membrane valve of a membrane-controlled crankcase inlet and this valve can correspond to the membrane valve 26 with respect to its configuration.

It is understood that the foregoing description is that of the preferred embodiments of the invention and that various changes and modifications may be made thereto without departing from the spirit and scope of the invention as defined in the appended claims.

What is claimed is:

1. A method for operating a two-stroke engine including a two-stroke engine for a portable handheld work apparatus, the two-stroke engine including: a crankcase; a cylinder connected to said crankcase; said cylinder having a cylinder wall defining a cylinder; a piston displaceably mounted in said cylinder for reciprocating movement therein and said piston and said cylinder conjointly defining a combustion chamber; a crankshaft rotatably mounted in said crankcase; a connecting rod connecting said piston to said crankshaft so as to permit said piston to drive said crankshaft as said piston reciprocates in said cylinder; said crankcase having an inlet through which an air/fuel mixture is drawn into said crankcase during an intake phase of said engine; a transfer channel for conducting said air/fuel mixture from said crankcase into said combustion chamber; and, a fluid channel communicating with said transfer channel; the method comprising the steps of:

drawing a fluid into said transfer channel through said fluid channel during said intake phase and storing the inducted fluid in said transfer channel with said fluid being a fuel-poor to fuel-free fluid; and, adjusting lambda (λ) of said air/fuel mixture stored in said crankcase in a range of 0.2 to 0.6.

2. The method of claim 1, wherein said engine is a piston-port controlled scavenging advance store engine.

3. A method for operating a two-stroke engine including a two-stroke engine for a portable handheld work apparatus, the two-stroke engine including: a crankcase; a cylinder connected to said crankcase; said cylinder having a cylinder wall defining a cylinder; a piston displaceably mounted in said cylinder for reciprocating movement therein and said piston and said cylinder conjointly defining a combustion chamber; a crankshaft rotatably mounted in said crankcase; a connecting rod connecting said piston to said crankshaft so as to permit said piston to drive said crankshaft as said piston reciprocates in said cylinder; said crankcase having an inlet through which an air/fuel mixture is drawn into said crankcase during an intake phase of said engine; a transfer channel for conducting said air/fuel mixture from said crankcase into said combustion chamber; and, a fluid channel communicating with said transfer channel; the method comprising the steps of:

drawing a fluid into said transfer channel through said fluid channel during said intake phase and storing the inducted fluid in said transfer channel with said fluid being a fuel-poor to fuel-free fluid; and, adjusting lambda (λ) of said air/fuel mixture stored in said crankcase in a range of approximately 0.3 to 0.5.

4. A method for operating a two-stroke engine including a two-stroke engine for a portable handheld work apparatus, the two-stroke engine including: a crankcase; a cylinder connected to said crankcase; said cylinder having a cylinder wall defining a cylinder; a piston displaceably mounted in said cylinder for reciprocating movement therein and said piston and said cylinder conjointly defining a combustion chamber; a crankshaft rotatably mounted in said crankcase;

a connecting rod connecting said piston to said crankshaft so as to permit said piston to drive said crankshaft as said piston reciprocates in said cylinder; said crankcase having an inlet through which an air/fuel mixture is drawn into said crankcase during an intake phase of said engine; a transfer channel for conducting said air/fuel mixture from said crankcase into said combustion chamber; and, a fluid channel communicating with said transfer channel; the method comprising the steps of:

drawing a fluid into said transfer channel through said fluid channel during said intake phase and storing the inducted fluid in said transfer channel with said fluid being a fuel-poor to fuel-free fluid;

adjusting lambda (λ) of said air/fuel mixture stored in said crankcase in a range of approximately 0.2 to 0.6; and, said lambda (λ) being greater than 0.6 at idle and dropping to a value of approximately 0.3 with increasing load.

5. A method for operating a two-stroke engine including a two-stroke engine for a portable handheld work apparatus, the two-stroke engine including: a crankcase; a cylinder connected to said crankcase; said cylinder having a cylinder wall defining a cylinder; a piston displaceably mounted in said cylinder for reciprocating movement therein and said piston and said cylinder conjointly defining a combustion chamber; a crankshaft rotatably mounted in said crankcase; a connecting rod connecting said piston to said crankshaft so as to permit said piston to drive said crankshaft as said piston reciprocates in said cylinder; said crankcase having an inlet through which an air/fuel mixture is drawn into said crankcase during an intake phase of said engine; a transfer channel for conducting said air/fuel mixture from said crankcase into said combustion chamber; and, a fluid channel communicating with said transfer channel; the method comprising the steps of;

drawing a fluid into said transfer channel through said fluid channel during said intake phase and storing the inducted fluid in said transfer channel with said fluid being a fuel-poor to fuel-free fluid;

adjusting lambda (λ) of said air/fuel mixture stored in said crankcase in a range of approximately 0.2 to 0.6; and, said lambda (λ) dropping approximately continuously as a function of load.

6. A method for operating a two-stroke engine including a two-stroke engine for a portable handheld work apparatus, the two-stroke engine including: a crankcase; a cylinder connected to said crankcase; said cylinder having a cylinder wall defining a cylinder; a piston displaceably mounted in said cylinder for reciprocating movement therein and said piston and said cylinder conjointly defining a combustion chamber; a crankshaft rotatably mounted in said crankcase; a connecting rod connecting said piston to said crankshaft so as to permit said piston to drive said crankshaft as said piston reciprocates in said cylinder; said crankcase having an inlet through which an air/fuel mixture is drawn into said crankcase during an intake phase of said engine; a transfer channel for conducting said air/fuel mixture from said crankcase into said combustion chamber; and, a fluid channel communicating with said transfer channel; the method comprising the steps of:

drawing a fluid into said transfer channel through said fluid channel during said intake phase and storing the inducted fluid in said transfer channel with said fluid being a fuel-poor to fuel-free fluid;

adjusting lambda (λ) of said air/fuel mixture stored in said crankcase in a range of approximately 0.2 to 0.6; and, said lambda (λ) remaining approximately constant in a part-load range following idle.

7. A method for operating a two-stroke engine including a two-stroke engine for a portable handheld work apparatus, the two-stroke engine including: a crankcase; a cylinder connected to said crankcase; said cylinder having a cylinder wall defining a cylinder; a piston displaceably mounted in said cylinder for reciprocating movement therein and said piston and said cylinder conjointly defining a combustion chamber; a crankshaft rotatably mounted in said crankcase; a connecting rod connecting said piston to said crankshaft so as to permit said piston to drive said crankshaft as said piston reciprocates in said cylinder; said crankcase having an inlet through which an air/fuel mixture is drawn into said crankcase during an intake phase of said engine; a transfer channel for conducting said air/fuel mixture from said crankcase into said combustion chamber; and, a fluid channel communicating with said transfer channel; the method comprising the steps of:

drawing a fluid into said transfer channel through said fluid channel during said intake phase and storing the inducted fluid in said transfer channel with said fluid being a fuel-poor to fuel-free fluid;

adjusting lambda (λ) of said air/fuel mixture stored in said crankcase in a range of approximately 0.2 to 0.6; and, the inducted fluid volume being essentially completely stored in the volume of the transfer channel.

8. A method for operating a two-stroke engine including a two-stroke engine for a portable handheld work apparatus, the two-stroke engine including: a crankcase; a cylinder connected to said crankcase; said cylinder having a cylinder wall defining a cylinder; a piston displaceably mounted in said cylinder for reciprocating movement therein and said piston and said cylinder conjointly defining a combustion chamber; a crankshaft rotatably mounted in said crankcase; a connecting rod connecting said piston to said crankshaft so as to permit said piston to drive said crankshaft as said piston reciprocates in said cylinder; said crankcase having an inlet through which an air/fuel mixture is drawn into said crankcase during an intake phase of said engine; a transfer channel for conducting said air/fuel mixture from said crankcase into said combustion chamber; and, a fluid channel communicating with said transfer channel; the method comprising the steps of:

drawing a fluid into said transfer channel through said fluid channel during said intake phase and storing the inducted fluid in said transfer channel with said fluid being a fuel-poor to fuel-free fluid;

adjusting lambda (λ) of said air/fuel mixture stored in said crankcase in a range of approximately 0.2 to 0.6; and, wherein said engine has a plurality of said transfer channels and each of said transfer channels has a volume lying between an entry window of said transfer channel to said combustion chamber and a transfer window to said crankcase; and, said total volume of said transfer channels is designed to be greater than the volume of said fluid inducted at full load.

9. The method of claim 8, wherein said total volume of said transfer channels amounts to approximately 15% to 35% of the piston displacement of said engine.

10. A method for operating a two-stroke engine including a two-stroke engine for a portable handheld work apparatus, the two-stroke engine including: a crankcase; a cylinder connected to said crankcase; said cylinder having a cylinder wall defining a cylinder; a piston displaceably mounted in said cylinder for reciprocating movement therein and said piston and said cylinder conjointly defining a combustion chamber; a crankshaft rotatably mounted in said crankcase; a connecting rod connecting said piston to said crankshaft so as to permit said piston to drive said crankshaft as said piston reciprocates in said cylinder; said crankcase having an inlet through which an air/fuel mixture is drawn into said crankcase during an intake phase of said engine; a transfer channel for conducting said air/fuel mixture from said crankcase into said combustion chamber; and, a fluid channel communicating with said transfer channel; the method comprising the steps of:

drawing a fluid into said transfer channel through said fluid channel during said intake phase and storing the inducted fluid in said transfer channel with said fluid being a fuel-poor to fuel-free fluid;

adjusting lambda (λ) of said air/fuel mixture stored in said crankcase in a range of approximately 0.2 to 0.6; and, wherein said lambda (λ) of the mixture, which participates in the combustion, is adjusted to approximately 0.70 to 0.95 over the entire load range.

11. A method for operating a two-stroke engine including a two-stroke engine for a portable handheld work apparatus, the two-stroke engine including: a crankcase; a cylinder connected to said crankcase; said cylinder having a cylinder wall defining a cylinder; a piston displaceably mounted in said cylinder for reciprocating movement therein and said piston and said cylinder conjointly defining a combustion chamber; a crankshaft rotatably mounted in said crankcase; a connecting rod connecting said piston to said crankshaft so as to permit said piston to drive said crankshaft as said piston reciprocates in said cylinder; said crankcase having an inlet through which an air/fuel mixture is drawn into said crankcase during an intake phase of said engine; a transfer channel for conducting said air/fuel mixture from said crankcase into said combustion chamber; and, a fluid channel communicating with said transfer channel; the method comprising the steps of:

drawing a fluid into said transfer channel through said fluid channel during said intake phase and storing the inducted fluid in said transfer channel with said fluid being a fuel-poor to fuel-free fluid;

adjusting lambda (λ) of said air/fuel mixture stored in said crankcase in a range of approximately 0.2 to 0.6; and, said engine being a membrane-controlled scavenging advance store engine.

12. A method for operating a two-stroke engine including a two-stroke engine for a portable handheld work apparatus, the two-stroke engine including: a crankcase; a cylinder connected to said crankcase; said cylinder having a cylinder wall defining a cylinder; a piston displaceably mounted in said cylinder for reciprocating movement therein and said piston and said cylinder conjointly defining a combustion chamber; a crankshaft rotatably mounted in said crankcase; a connecting rod connecting said piston to said crankshaft so as to permit said piston to drive said crankshaft as said piston reciprocates in said cylinder; said crankcase having an inlet through which an air/fuel mixture is drawn into said crankcase during an intake phase of said engine; a transfer channel for conducting said air/fuel mixture from said crankcase into maid combustion chamber; and, a fluid channel communicating with maid transfer channel; the method comprising the steps of:

drawing a fluid into said transfer channel through said fluid channel during said intake phase and storing the inducted fluid in said transfer channel with said fluid being a fuel-poor to fuel-free fluid;

adjusting lambda (λ) of said air/fuel mixture stored in said crankcase in a range of approximately 0.2 to 0.6; and, the engine having a membrane-controlled or rotating-disc controlled mixture inlet and a piston-port controlled fluid inlet.

* * * * *

UNITED STATES PATENT AND TRADEMARK OFFICE

CERTIFICATE OF CORRECTION

PATENT NO. : 6,912,979 B2 
DATED : July 5, 2005
INVENTOR(S) : Claus Fleig, Werner Geyer and Joerg Schlossarczyk It is certified that error appears in the above-identified patent and that said Letters Patent is hereby corrected as shown below:

Title page,
Item [57], ABSTRACT,
Line 3, delete "in" and insert -- is -- therefor.

Column 7,
Line 35, delete "of;" and insert -- of: -- therefor.

Column 10,
Lines 24 and 25, delete "maid" and substitute -- said -- therefor.

Signed and Sealed this

Sixth Day of September, 2005

JON W. DUDAS
*Director of the United States Patent and Trademark Office*